US006881266B1

(12) United States Patent
Daykin et al.

(10) Patent No.: US 6,881,266 B1
(45) Date of Patent: Apr. 19, 2005

(54) APPARATUS AND METHOD FOR COATING PIPES

(75) Inventors: Damian Daykin, Cliterhoe (GB); David Ham, Feniton (GB); Adrian Kelly, Darwen (GB); Derek John Peel, Eaton (GB)

(73) Assignee: Pipeline Induction Heat Ltd., Burnley (GB)

( * ) Notice: Subject to any disclaimer, the term of this patent is extended or adjusted under 35 U.S.C. 154(b) by 0 days.

(21) Appl. No.: 10/129,048

(22) PCT Filed: Oct. 30, 2000

(86) PCT No.: PCT/GB00/04173

§ 371 (c)(1),
(2), (4) Date: Sep. 23, 2002

(87) PCT Pub. No.: WO01/32316

PCT Pub. Date: May 10, 2001

(30) Foreign Application Priority Data

Oct. 30, 1999 (GB) ..... 9925717
Apr. 5, 2000 (GB) ..... 0008297

(51) Int. Cl.[7] ..... B05B 13/04; B05C 5/00

(52) U.S. Cl. ..... 118/305; 118/50; 118/302; 118/323; 118/326; 118/DIG. 11; 427/427.1; 427/427.3

(58) Field of Search ..... 118/50, 302, 305, 118/315, 316, 319, 323, 326, DIG. 11; 427/295, 350, 383.1, 384, 478, 427.1, 427.3, 421

(56) References Cited

U.S. PATENT DOCUMENTS

| | | | |
|---|---|---|---|
| 4,007,705 | A | 2/1977 | Sherer et al. |
| 4,205,694 | A | 6/1980 | Thompson et al. |
| 4,595,607 | A | 6/1986 | Betteridge et al. |
| 5,207,833 | A | 5/1993 | Hart |
| 5,520,734 | A | 5/1996 | Taylor et al. |

FOREIGN PATENT DOCUMENTS

| | | |
|---|---|---|
| DE | 3827251 A1 | 2/1990 |
| FR | 78 05089 | 9/1978 |
| GB | 2285592 A | 7/1995 |
| WO | PCT/GB00/04173 | 10/2000 |

*Primary Examiner*—Katherine Bareford
(74) *Attorney, Agent, or Firm*—Barlow, Josephs & Holmes, Ltd.

(57) ABSTRACT

Apparatus for spraying a coating onto the outside of a pipe includes a body for mounting on a pipe to be coated. A spray gun is mounted on the body such that it can move relative to the body to spray coating completely around the periphery of the pipe. The apparatus may include only a single spray gun which is able to travel in a 360 degree range of motion around the periphery of the pipe. The apparatus is particularly suited to coating girth welds of a pipeline.

31 Claims, 5 Drawing Sheets

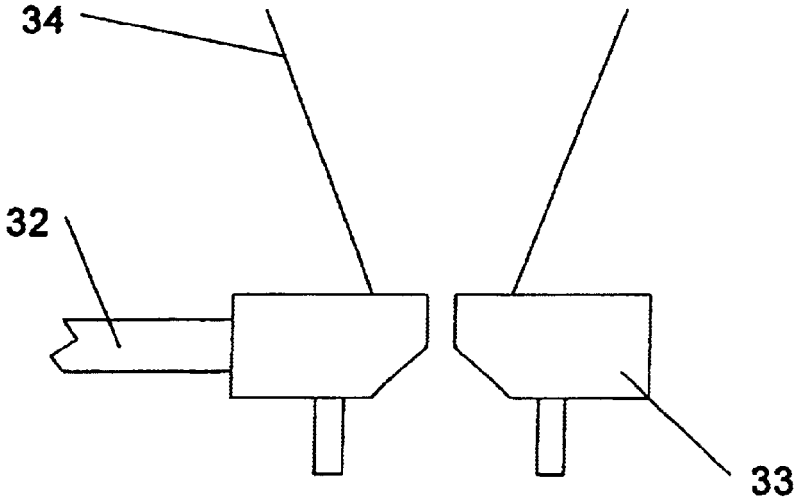
Fig 8
Fig 9
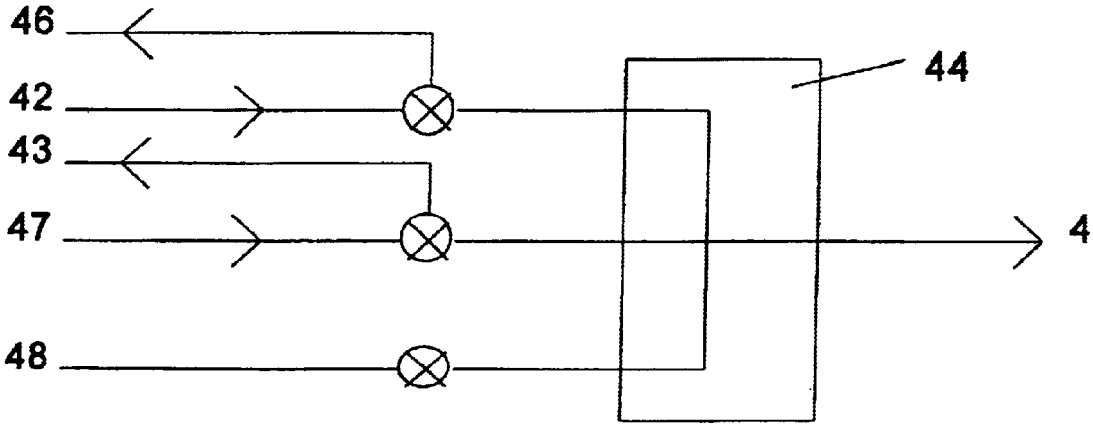

APPARATUS AND METHOD FOR COATING PIPES

APPARATUS AND METHOD FOR COATING PIPES

This is a national stage application of PCT/GB00/04173, filed Oct. 30, 2000.

The present invention relates to an apparatus and method for coating pipes and particularly, but not exclusively, to apparatus and methods for coating girth welds on oil and gas pipelines on site where the pipeline is being laid.

BACKGROUND OF THE INVENTION

Oil and gas pipelines are usually formed from many lengths of externally coated steel pipe which are welded together before they are laid. The pipes are coated to prevent corrosion and are usually coated at a factory remote from the site where they are to be laid. This is generally more cost effective than coating them at the site. At the factory coating is applied to the outside of the pipes leaving a short length, about 15 cm, uncoated at each end. This is necessary to enable the pipes to be welded together and to end on site to form a pipeline. Each resulting girth weld and adjacent uncoated region of the pipe must be coated before the pipeline is laid.

Many types of coating techniques are known. The present invention is concerned with coatings which are sprayed onto the pipeline as a liquid and subsequently set, for example a two part polyurethane coating. This is supplied as two liquids which when mixed together set chemically. Conventionally liquid coatings are applied to girth welds manually using conventional spray guns. This is time consuming. Pipeline joints need to be coated at the rate the pipelin is being laid. Commercial pressure necessitates that this happens as quickly as possible. In some instances up to 500 joints must be coated per day. Several operatives are required to achieve this, which is costly. It is difficult for operatives to apply an even coating all around the surface of a pipe, especially when under considerable time pressure. Often the top and sides of pipes received a much thicker layer of coating than the underside. This is undesirable. The coatings used are often toxic and present an environmental hazard. It is preferred that operatives are not exposed to the coating and that as little as possible enters the environment. With manual spraying it is found that a significant fraction of the coating used enters the environment as overspray and through flushing the spraying apparatus.

It is an object of embodiments of the present invention to address these and other problems associated with manual coating of pipeline welds on site.

Apparatus for coating pipes is know. U.S. Pat. No. 5,207,833 discloses a machine for applying a protective coating to a pipe or pipeline as the machine travels down the pipe. The machine comprises a two piece yoke which separates at the top and bottom to enable it to be fitted around the pipe. Each of the two pieces of the yoke serve as a track on which a spray gun moves, one spray gun flexibly mounted on each of the two pieces. The spray guns are aimed at the pipe and are moved up and down opposite each other by means of a gear b it drive mechanism. As this machine is for line coating of pipe it is generally unsuitable for coating girth welds on site and also has a number of other drawbacks. In particular it is rather cumbersome and would therefore be difficult to rapidly mount and dismount on a pipe, as required when coating welds on site. The materials used to coat field welds often cause blockages within spray guns. With two spray guns the risk of a blockage occurring is double that of a single gun. The two gun arrangement also necessitates either complex valving so that they operate individually, or a second pumping system. This is inconvenient and/or expensive. Also, because each gun can only travel through 180° to apply a coating all around the outside of a pipe it is necessary for them to tilt at the end of each movement. This is also inconvenient and increases losses due to overspray. Having two guns also means that there are two points at which the coating applied to a pipe will overlap increasing the risk that the coating will run or sag. If the output of the two guns is not carefully matched coating will not be evenly applied all over the pipe. Two guns also increases wastage of coating when the spraying equipment is flushed. This is a particularly important consideration when coating welds on site as the spraying apparatus needs to be flushed between each weld. The machine includes deflectors to divert the flow of liquid away from the guns during flushing upon which the flushing liquid will enter the environment. This is undesirable. Indeed, in some countries contemporary environmental concerns are such that such operations would be forbidden. Fumes may also enter the environment during both spraying and flushing.

It is further object of embodiments of the present invention to provide an apparatus and method which addresses the problems associated with the machine described in U.S. Pat. No. 5,207,833. It is a still further object to provide apparatus for coating pipeline welds on site more quickly, conveniently end with less environmental impact and coating waste than hitherto.

GB 2285592 discloses apparatus for spray coating a non-rotating pipe comprising a support frame carrying a rotary frame, and a spray head mounted on the rotary frame. The rotary frame is free to rotate through 360°.

SUMMARY OF THE INVENTION

According to a first aspect to the present invention there is provided apparatus for spraying a coating onto the outside surface of a pipe comprising a body for mounting on a pipe to be coated, a support mounted on the body and a spray gun mounted on the support wherein the support can move relative to the body to enable the spray gun to spray coating completely around the periphery of the pipe characterised in that the spray gun is pivotally mounted on the support and can be pivoted relative to the support so as to direct its spray away from the surface of the pipe.

According to a second aspect of the present invention there is provided apparatus for spraying coating onto the outside surface of a pipe comprising a body for mounting on a pipe to be coated and a spray gun which can move to spray coating completely around the periphery of the pipe characterised in that the spray gun is pivotally mounted and can be pivoted to direct its spray away from the surface of the pipe.

According to a third aspect of the present invention there is provided a method of spraying a band of coating completely around the periphery of a pipe comprising the steps of providing apparatus according to either the first or second aspect of the present invention, mounting the body of the apparatus on a pipe to be coated, causing the spray gun to spray a coating towards the surface of the pipe and moving the spray gun relative to the body around the periphery of the pipe sufficiently to spray a band of coating completely around the periphery of the pipe.

The apparatus and method enable a coating to be applied completely around the periphery of a pipe using only one spray gun, whilst the body of the apparatus remains rotationally fixed relative to the axis of the pipe. This provides for relatively simple apparatus and minimises the amount of waste produced when flushing the spray gun. It also means that there need only be one point where the coating overlaps, reducing the risk of the coating sagging or running.

By completely around the periphery of the pipe it is to be understood that the coating extends 360° or more around the pipe. The coating could be applied as a continuous band or in a helical fashion.

Preferably there is only one spray gun.

Preferably the spray gun can travel around the pipe to be coated. Preferably the spray gun can be moved through at least 360°, more preferably at least 370°, around a pipe to be coated. Preferably the body is of the shape of a ring with part removed so that it may be passed over a pipe to partially encircle the pipe. In particular the body may be horseshoe shaped. This enables the apparatus to be easily and quickly mounted on and demounted from a pipe. The body preferably includes a means for clamping it to the pipe, so that it is fixed relative thereto. This is preferred when applying a band of coating, for example when coating a weld. The body could however be arranged to travel along a pipe. The clamping means may comprise one or more actuators arranged to urge feet to grip a pipe. The spray gun is preferably mounted on a support mounted for rotation on the body so that it can travel around the periphery of a pipe on which the body is mounted. The support preferably comprises a substantially annular ring formed from two or more pivotally connected segments so that it may be opened to enable it to be placed over a pipe. Preferably at least one segment of the ring occupies less than 90° of its circumference, so that the ring may be opened whilst leaving the majority of the ring intact. At least one actuator is preferably provided for opening and closing the ring. A locking means is preferably provided for locking the ring in the closed position. The ring is preferably supported on wheels mounted on the body. A drive means is preferably provided for rotating the ring relative to the body.

The spray gun is preferably mounted on the ring so that it will spray coating in a substantially radial direction towards a pipe on which the body is mounted. The spray gun may be movably, especially pivotally, mounted on the ring so that it may be moved, especially turned, to spray away from the surface of a pipe, for example through 90° to spray tangentially to the pipe. The spray gun may comprise a nozzle with a rotatable tip and an actuator for rotating the tip, to enable the tip to be reversed to clear blockages. With the tip in one position the spray gun preferably produces a fan shaped spray and in the other position, a jet. The spray gun is preferably fitted with a cowl to contain overspray.

Preferably the apparatus further comprises an extraction unit adapted to collect fumes and waste during spraying. More preferably the extraction unit is adapted to collect substantially all the fumes and waste produced during spraying.

This has the advantage that the extraction unit collects fumes produced during spraying and thereby allows spraying to take place in a confined area, such as inside a laybarge.

Preferably the extraction unit comprises a hood which substantially surrounds the spray gun. Preferably the extraction unit is mounted on the body and can move relative to the body to follow the motion of the spray gun. Preferably the extraction unit is mounted to the spray gun. Preferably the extraction unit is connected to a vacuum system which draws air into the extraction unit. Preferably the extraction unit is connectable to a collector for filtering and retaining toxic wasted from said fumes.

The apparatus may be adapted for spraying at least a two part coating. In this case it preferably includes a mixing block in which the at least two parts are combined before being fed to the spray gun. The mixing block may be mounted on the body and could be mounted on the ring or spray gun to minimise the length of tubing required between block and gun, to minimise the amount of mixed coating that must be flushed from the tubing at the end of each coating operation. This is necessary to prevent coating setting in the tubing. Valve means are preferably provided to admit either the two parts f th coating or a flushing solvent to the mixing block.

The apparatus preferably comprises a control means for controlling operation of the spray gun, drive means and various actuators. The control means may comprise a pneumatic control means.

The method preferably includes one or more of the following steps: clamping the body onto the pipe after mounting, directing the spray gun away from the pipe, turning the nozzle tip to the jet position, flushing the spray gun with solvent, priming the spray gun with coating, stopping the flow of coating, turning the nozzle tip to the spray position, and turning the spray gun towards the pipe, before causing the spray gun to spray coating at the pipe.

In most applications the pipe will be horizontal, in this case it is preferred that the spray gun is moved so the spray will be directed downwardly towards the top of the pipe before spraying coating. This ensures that any overlap in the coating is on the top of the pipe where it is least likely to cause a run. Pipes could, however, be coated in other orientations.

When spraying is commenced the spray gun is preferably moved around the pipe in a circular path through at least, and preferably just over, 360°, at a substantially constant distance from the pipe with the spray directed radially towards the pipe. The gun is then preferably stopped and reversed and travels back to its starting position. During reversal the spray may be momentarily stopped to reduce the risk of over-coating the pipe at that point.

The spray gun may move around and return around the pipe as many times as necessary to achieve the desired coating thickness. When this has been achieved the spray is preferably stopped, the spray gun turned away from the pipe, the nozzle tip turned to the jet position and the gun flushed with solvent.

The apparatus may then be released from the pipe and lifted off.

Any or all of the steps of operation of the apparatus may be controlled by the control means. The method may be for applying a continuous band of coating to a pipe.

During priming and flushing of the spray gun it is preferred that the jet produced by the gun is directed into a receptacle, so that the discharged product may be safely disposed of. The receptacle is preferably connected to a vacuum system which draws air into the receptacle. This helps to contain the jet from the nozzle. The receptacle is preferably brought close to the spray gun during priming and flushing. The receptacle and/or vacuum apparatus may be mounted on the body of the apparatus. Preferably the receptacle and the extraction unit are connected to the same vacuum apparatus. Preferable the extraction unit comprises said receptacle.

According to a third aspect of the present invention there is provided a coating for filling a gap between coated portions of a pipe, the coating being formed from an at least two component system which is adapted to be admixed before it is sprayed into said gap by said apparatus for spraying.

By spraying it is possible to apply a thinner coating for a subsee application, when compared to the conventional method of injection of a coating into a mould surrounding a pipe to be coated. The conventional mould method typically produces a coating 5 to 50 mm thick, whilst by spraying one can produce a coating of 2.5 mm thickness. This leads to reduced costs, because less material is used. Also, better adhesion is achieved because the coating is less thick it is less likely to separate from the factory applied coating when the pipeline is bent during deployment.

Preferably the coating is elastomeric. This further improves the adherence of the coating because it is able to bend with the pipeline.

Preferably the coating is a polyurethane product. Polyurethane normally sets in approximately 3 seconds which is too fast to allow it to be sprayed because it would set in the nozzle, thereby one of the components of the two part system is preferably a catalyst which slows the setting time to between 10 seconds to 4 minutes depending on the speed required for a particular application. Polyurethane is not normally used in subsea applications because it is more costly than the usually used polyolefin. Also the usual method of application, injection into a mould, requires a considerable quantity of this product. However by being able to apply by spraying in an enclosed environment a thinner coating is applied, making it more cost effective to use. Polyurethane has particularly good properties for use in an environmentally unfriendly application, such as subsea. Also it is able to adhere better to a large number of factory applied coatings for example FBE (Fusion bonded epoxy) polyolefin, polypropylene, polyethylene, polyurethane, concrete and others.

Preferably the shore hardness of the coating is 70A to 70D.

Preferably the density of the coating is 900 to 1500 kgs per $in^3$.

Preferably the tensile strength of the coating is 5 to 20 MPA.

According to a fourth aspect of the present invention there is provided a method of filling a gap between coated portions of a pipe comprising the steps of mixing at least two components of an at least two component system to form a settable polyurethane compound, spraying the polyurethane compound around the pipe in order to fill said gap and collecting fumes produced during the spraying process for safe disposal thereof.

Preferably, the gap is abrasively cleaned before the coating is applied.

Preferably the edges of the existing pipe coating is treated with a corona discharge before the gap is filled.

Preferably the temperature of the gap is in the range 50° C. to 80° C. during the application of the coating. This helps to set the polyurethane. Furthermore in the previous method of applying a coating using a mould it was necessary to bring the temperature of the gap up to 240° C., which is higher than the welding temperature of 160°. This therefore entailed an additional heating step in the process with subsequent time and energy costs. The lower temperature of the present application is achieved as the welded area cools.

BRIEF DESCRIPTION OF THE DRAWINGS

In order that the invention may be more clearly understood an embodiment thereof will now be described, by way of example, with reference to the accompanying drawings in which:

FIG. 8 shows an enlarged cross sectional view of the tip of the spray gun; and FIG. 9 is a schematic view of the valving for the spray gun.

DETAILED DESCRIPTION OF THE INVENTION

Figure 3:
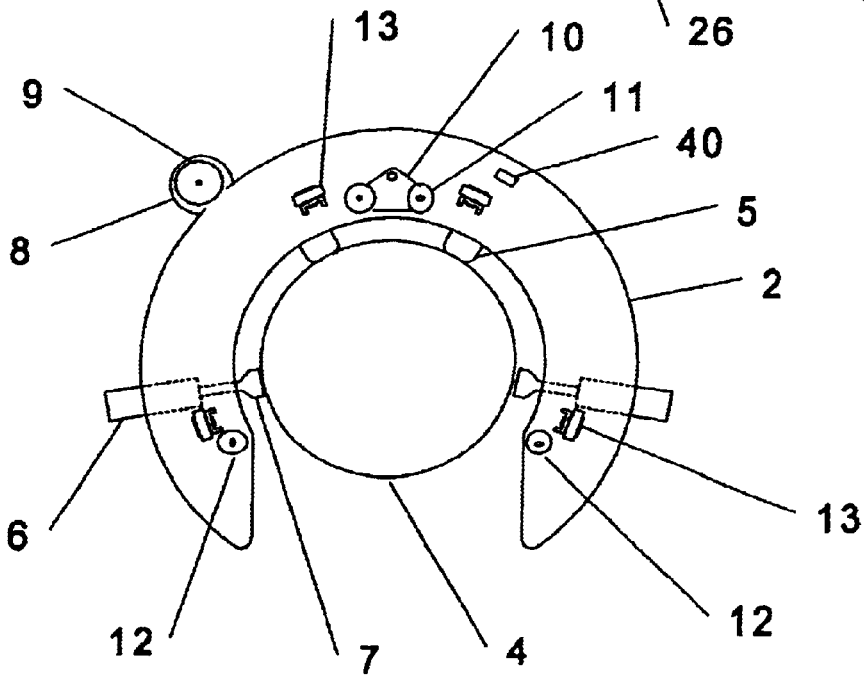
FIG. 3 is an end view of the stator of the apparatus of FIG. 1, mounted on a pipe.
Figure 4:
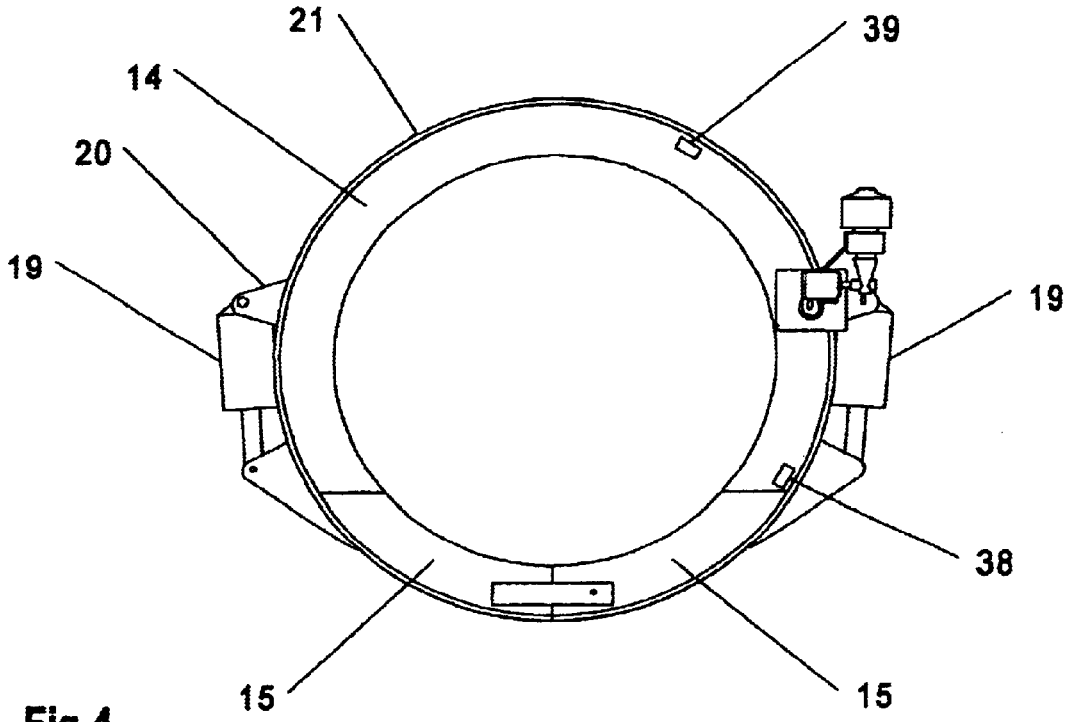
FIG. 4 is an end view of the rotor of the apparatus of FIG. 1, in the closed position with the gun assembly in the flush/prime position.

Referring to the drawings, the apparatus comprises two main parts, a stator shown separately in FIG. 3 and a rotor shown separately in FIG. 4. The stator comprises two horseshoe shaped plates 1 and 2 connected in a parallel, spaced apart manner by tie bars 3, so that the openings in each plate coincide. The shape of plates 1 and 2 enables the apparatus to be quickly lowered onto a pipe 4. Mounted on and fixed relative to each of the two uppermost (as illustrated, which is the normal orientation in which the apparatus would be used) tie bars 3 are two rubber faced feet 5 which support the stator when placed onto a pipe 4. Mounted on each of the two lower tie bars 3 is a pneumatic cylinder 6 which houses a piston connected to a rubber faced foot 7. The cylinders 6 are operative to move the feet radially inwards to clamp the stator onto a pipe 4, so that it is fixed relative to the pipe.

Also mounted on the stator is a pneumatic motor 8 arranged to drive a sprocket 9 the axis of rotation of which is substantially perpendicular to the plane of plate 2, and therefore substantially parallel to the axis of a pipe 4 to which the apparatus is fixed. The plane of rotation of the sprocket 9 is displaced from that of plate 2 in a direction opposite to that of plate 1. A support carriage 10 is mounted towards the top of plate 1, it carries two wheels 11 side by side, both of which lie in substantially the same plane as sprocket 9. Two further wheels 12 are mounted towards the bottom of plate 1, also substantially in the plane of the sprocket 9. Part of the edge of each of wheels 11 and 12 lie on a circle concentric with the plate 2. Four pairs of further wheels 13 the axis of rotation of which are perpendicular to those of wheels 11 and 12 are spaced around plate 1. The plane of rotation of each pair of wheels 13 is tangential to a circle which is concentric with the plate 2. Each of the wheels 13 of each pair are spaced apart by a similar amount. Wheels 11, 12 and 13 are faced with a resilient material, for example rubber.

The purpose of the various wheels on the stator is to support the rotor, shown separately in FIG. 4. The rotor comprises a substantially annular aluminium ring formed from five connected parts. One part 14 is horseshoe shaped, two further parts 15 are mirror opposites of each other and together with part 14 complete the ring. The remaining two parts 16 are generally triangular in shape and are also mirror opposites. They serve to connect parts 15 to part 14. They are connected to part 14 by way of pivots 17 and rigidly connected to parts 15 by bolts 18. Pivots 17 enable parts 15 and 16 to hinge away from part 14 to open the ring to enable it to pass over a pipe 4. Parts 16 are also pivotally connected to respective pneumatic actuators 19 each of which comprise a piston and cylinder and are also pivotally connected to brackets 20 fastened to part 14. Actuators 19 are arranged to open and close the ring by moving parts 15 and 16 relative to part 14. Left hand part 15 includes a plate 15*a* with an aperture 15*b* which aligns with a pin 15*c* operated by a pneumatic actuator (not shown) mounted on right hand part 15 when the two parts 15 are closed together. Actuator can move the pin 15*c* through the aperture 15*b* to lock parts 15 together.

Figure 1:
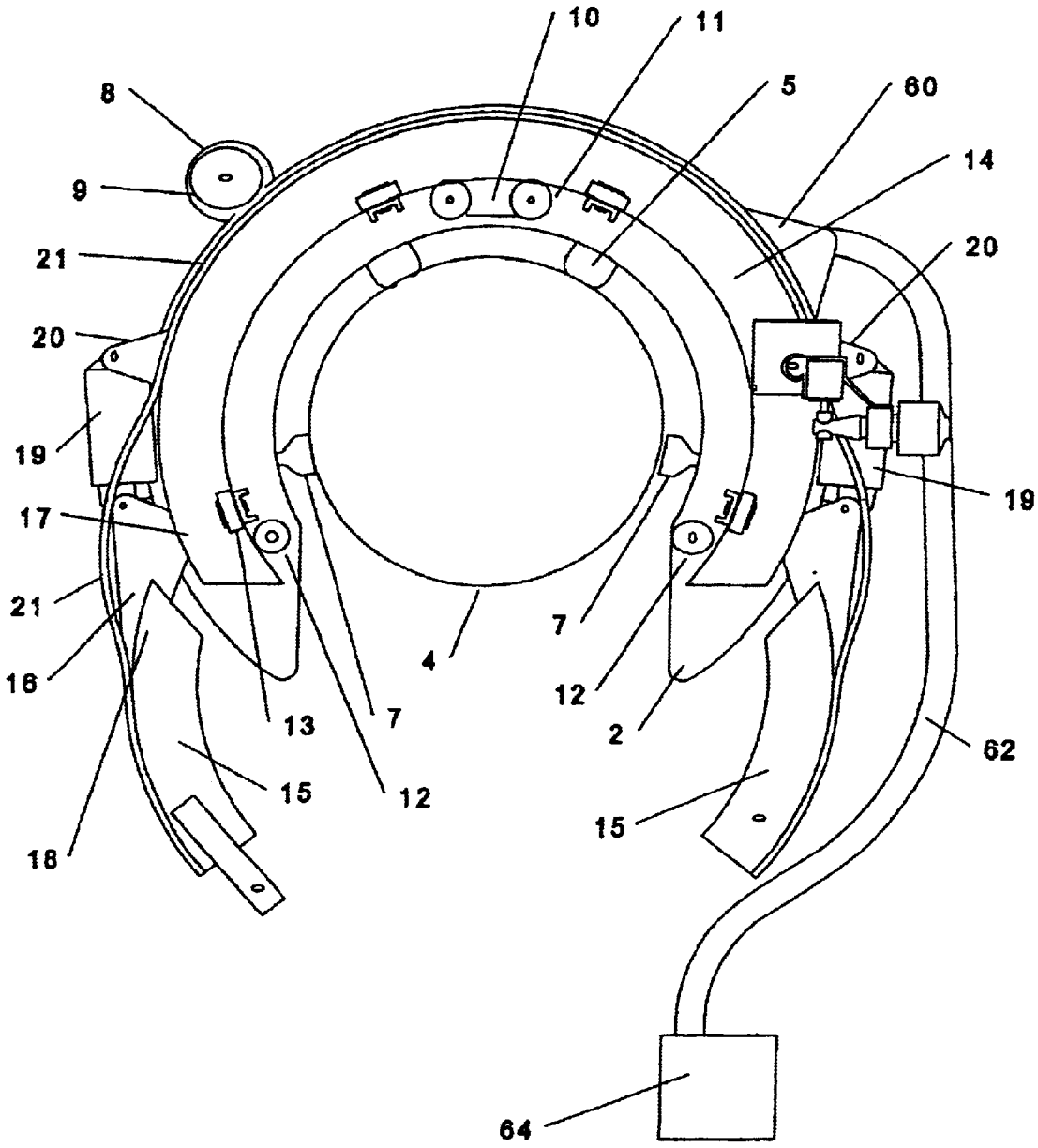
FIG. 1 is an end view of apparatus according to the invention, mounted on a pipe.

Running around the periphery of parts 14 and 15 is a chain 21, it is fastened at a number of places to each of parts 14 and 15 to hold it in place, whilst allowing the ring to open, as shown in FIG. 1. When the ring is closed the ends of the chain meet so that it runs continuously around the ring.

Figure 6:
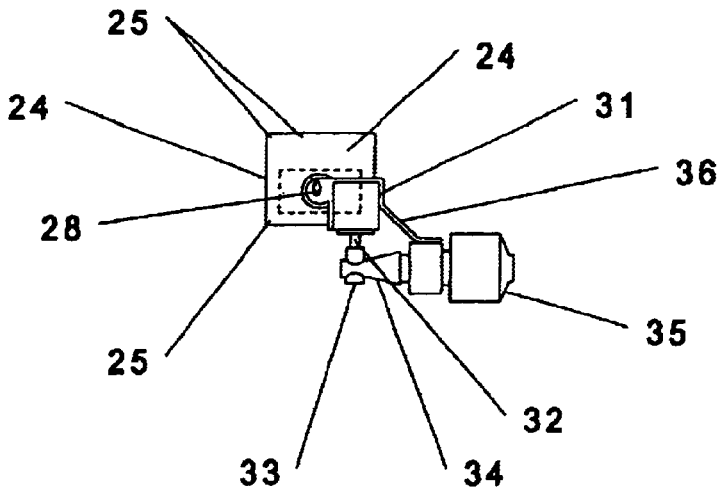
FIG. 6 is an enlarged view of the spray gun of the apparatus of FIG. 1 in the spray position.
Figure 7:
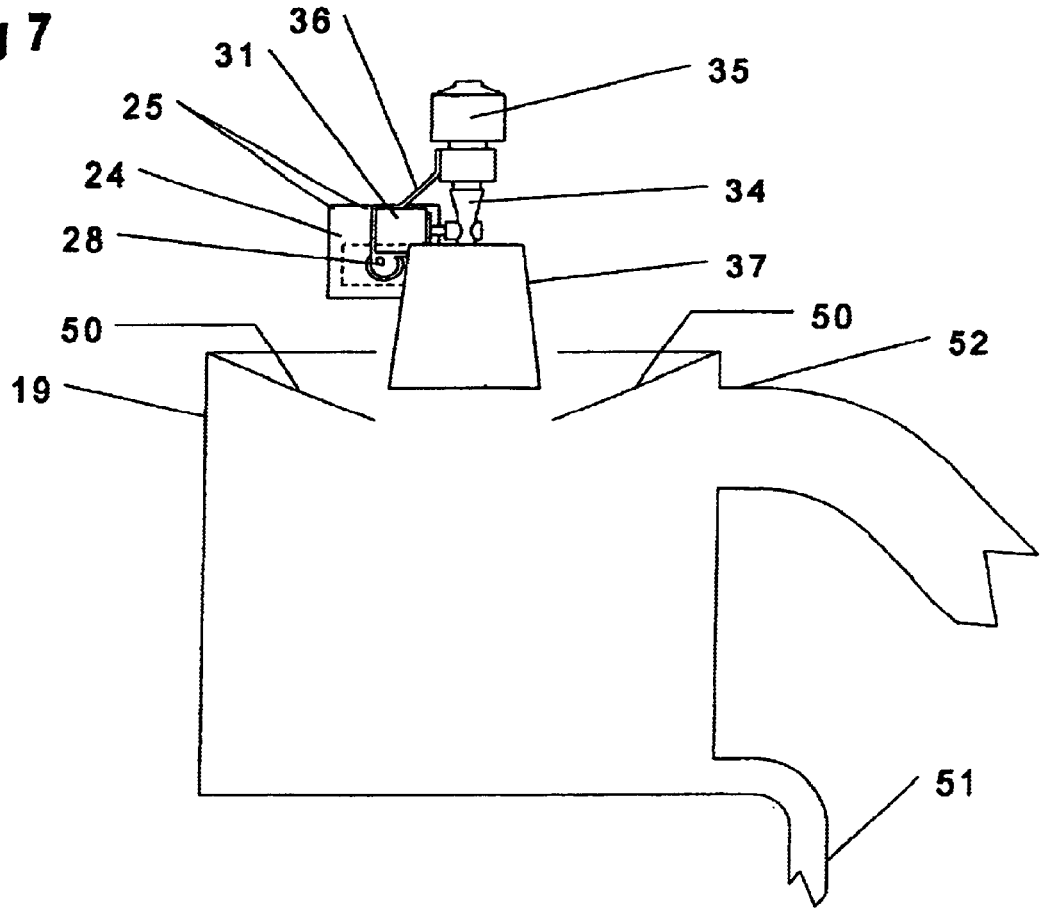
FIG. 7 is an enlarged view of the spray gun in the flush/prime position taken along the line A—A of FIG. 2 and also shows vacuum apparatus for containing waste material.

Also mounted on the ring is a spray gun assembly, shown separately in FIGS. 6 and 7. The assembly comprises a support plate 22 which is fastened to part 14 of the rotor ring. The bars 23 are fastened to the support plate 22. They support a first bearing plate 24 which is spaced apart from and parallel to the support plate 22. Further the bars 25 extend from the first bearing plate 24 to a second bearing plate 26, spaced apart from and parallel to the first bearing plate 24. Mounted on the first bearing plate 24, between the first bearing plate and the support plate 22 is a pneumatic rotary actuator 27, this is connected to a shaft 28 which runs in bearings 29 and 30 in the first and second bearing plates 24 and 26 respectively. Mounted on and for rotation with the shaft 28 is a further rotary actuator 31 for rotating a shaft 32 connected to the rotating tip 33 of the nozzle of a spray gun 34 comprising a control actuator 35 and supported by a bracket 36. Actuator 35 enables a passage for fluid through the spray gun 34 to be rapidly opened and closed, to start and stop the flow of fluid through the gun.

Figure 2:
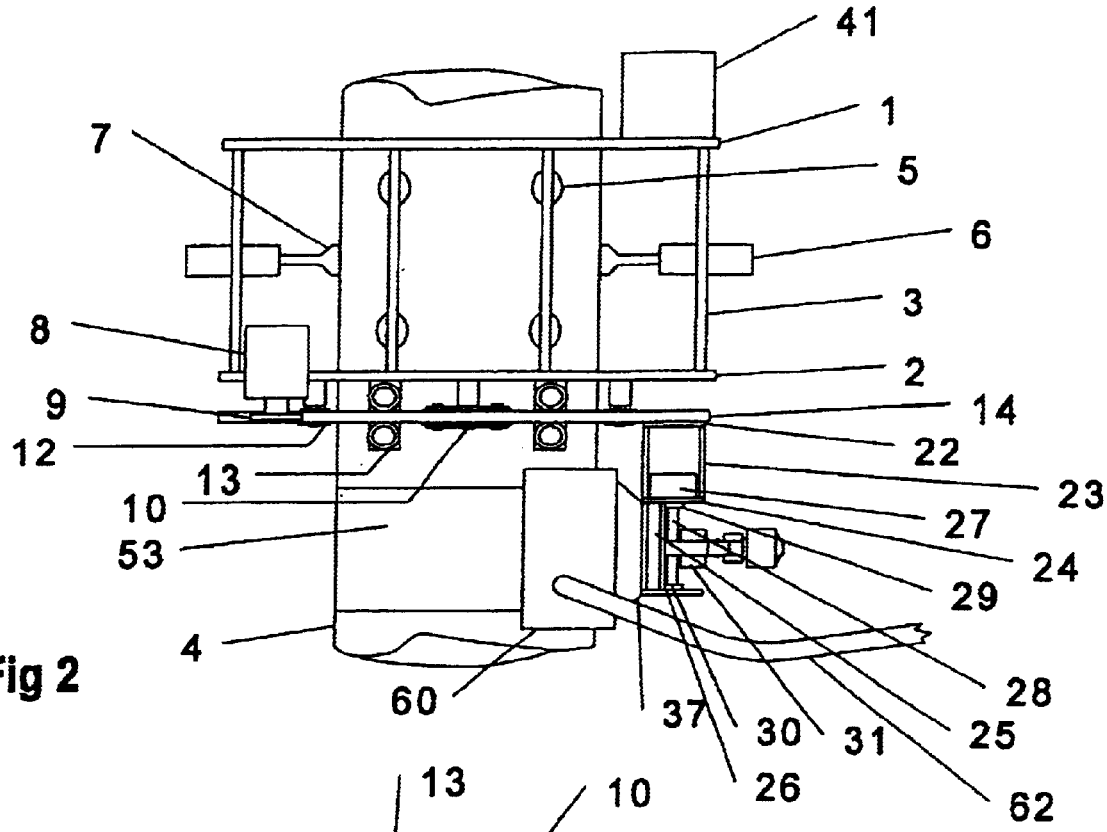
FIG. 2 is a plan view of the apparatus of FIG. 1, also mounted on a pipe.
Figure 5:
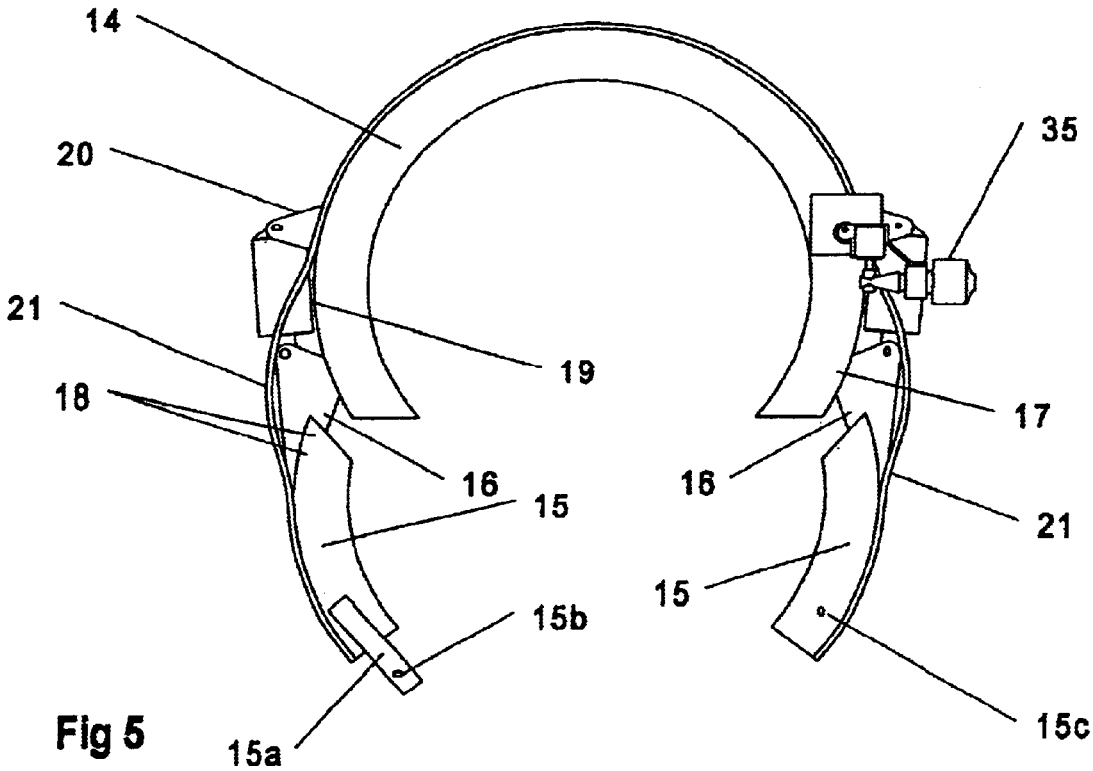
FIG. 5 is an end view of the rotor of the apparatus of FIG. 1, in the open position with the gun assembly in the spray position.

Rotary actuator 27 is operative to move actuator 31 and the spray gun assembly through 90° relative to the ring of the rotor and bearing plates, between spray and flush/prime positions as shown in FIGS. 5 and 4 respectively. In the spray position the spray gun is aimed radially towards pipe 4, in the flush/prime position it is aimed tangentially to the pipe. Rotary actuator 31 is operative to rotate shaft 32 through 180° to reverse to nozzle tip 33. The nozzle tip 33 includes an orifice which when liquid is forced through in one direction produces a fan like spray 'the spray position' and the other direction a jet 'the jet position'. The nozzle tip is rotatably mounted in the spray gun 34. Mounted on the spray gun is a cowl 37 of suitable size and shape to accommodate the spray produced by the nozzle. For clarity this is only shown in FIGS. 2 and 7.

The ring of the rotor is supported for rotation relative to the stator on wheels 11. Wheels 12 serve to ensure that the ring remains concentric with the stator, and any pipe 4 on which it is mounted. The ring of the rotor also runs between each pair of wheels 13 which serve to restrain the ring axially. Sprocket 9 engages with chain 21 to enable the motor 9 to rotate the rotor relative to the stator. When so mounted home 38 and top 39 position sensors, the positions of which are shown in FIG. 4, but which are actually mounted on the opposite side of part 14, will contact trigger 40 on plate 2 as the rotor rotates and the spray gun assembly passes the home (3 o'clock) and top (12 o'clock) positions respectively. It will be apparent from the description so far that the rotor may rotate any number of times relative to the stator. However, what is not shown in the drawings, for clarity, are the numerous pneumatic tubes required to operate the motor 9, position sensors and various actuators described which are also connected to a pneumatic control unit 41, mounted on the stator and in turn connected to a compressed air supply. The connection of the rotor and stator by tubes limits the number of rotations the rotor may make, to about one and a half times. Although the tubes could be made longer to allow for more rotation there would be a considerable risk of them becoming tangled.

The spray gun is also connected to a tube to deliver coating and a flushing solvent. The tube is connected to the circuit shown in FIG. 8. Two components of a two part coating described further below are supplied under pressure along lines 42 and 43 from reservoirs thereof, to diverter valves A and B respectively. These valves serve to direct flow of the coating components either to a mixing block 44 through which the coating can flow to the nozzle along line 45 or back to the reservoirs along lines 46 and 47. Solvent for flushing the nozzle is supplied along line 48 via valve C to the mixing block 44. This circuit could be mounted on the stator, rotor or provided separately.

An extraction unit (illustrated only in FIGS. 1 and 2 for clarity) comprising a hood 60 which substantially surrounds the trajectory of the spray from the spray nozzle is mounted to the spray gun 34 for movement therewith. The hood 60 is connected to a master extraction unit or vacuum source 64 for extracting fumes produced during spraying via extraction hose 62. The master extraction unit 64 comprises a collector 66 for retaining toxic waste from the fumes extracted for subsequent safe disposal thereof and to reduce their emission into the surrounding environment.

In FIG. 7 the nozzle of the spray gun is shown directed into a receptacle 49 which is shown in cross-section to reveal baffles 50. The bottom of the receptacle includes a drain 51 and hose 52 is connected near its top which is connected to a further receptacle (not shown) which is in turn connected to a pneumatically operated air pump (not shown) which is operative to evacuate air from the receptacle and therefore cause air to flow into receptacle 49. Receptacle 49 is intended to contain waste liquid flushed from the nozzle. The second receptacle is intended to trap any liquid which finds its way along hose 52 for instance in the event that receptacle 49 becomes full. Receptacle 49 may be mounted on the stator, so that the spray gun is always directed towards it when in the flush/prime position.

The apparatus is for coating girth welds on pipes, particularly on site where a pipeline is being laid. Pipelines being laid on land are typically supported in a horizontal fashion, above ground, before being buried.

The pipe sections are welded together and the uncoated area adjacent the weld cleaned using abrasive blasting to remove corrosion and to present a roughened surface to aid adhesion of coating and a primer applied. The end edges of the factory coated portions of the pipes are treated with a corona discharge which improves their bonding to the coating to be applied. The temperature of the area is then measured using a temperature crayon and when in the range 50 to 80° C. (the temperature of the initial weld is in the region of 160° C.) the coating is applied. The apparatus is used to coat the uncoated weld region 53 of a pipe 4 by spraying on a band of coating as follows. The ring of the rotor is opened by releasing locking pin 15*c* and actuators 19. The apparatus is then lowered over and onto the pipe 4 so that it rests on feet 5. Whilst the ring of the rotor is open it will preferentially adopt the position shown in FIG. 1 with the opening lowermost, due to its weight distribution. Cylinders are then operated to clamp the stator to the pipe and at the same time the ring of the rotor is closed and locked by operating actuators 19 and the locking pin actuator. The apparatus is now ready to coat the pipe.

The next stage is to flush the spray gun. The gun starts in the position shown in FIG. 4, that is in the home position relative to the stator and turned away from the pipe, the flush/prime position. The nozzle tip 33 is in the reverse position. Receptacle 49 is brought towards the cowl of the spray gun and valve C and actuator 35 opened to admit solvent to the gun to flush the nozzle. A jet of solvent issues from the nozzle into the receptacle where it collects. Any splash back is contained by baffles and the flow of air into the receptacle. When the receptacle fills the accumulated waste liquid can be drained through drain 51 for safe disposal. During this operation air is drawn through the receptacle to ensure that all the solvent is retained in the receptacle. The control means includes a flush control which causes the apparatus to operate as outlined above.

Following flushing the gun is primed, by operating a prime control. This causes valve C to be closed and valves A and B to operate to direct the flow of coating to the mixing block 44. The two coating components flow through the mixing block, where they combine, to the nozzle. A small amount of coating is allowed to issue from the nozzle into the receptacle to ensure that all the solvent has been purged from the lines and spray gun.

Once the nozzle is primed the coating operation can begin, this operation also occurs automatically under control of the control unit. Actuator 35 operates to stop the flow of coating, at the same time actuator 31 turns the nozzle tip through 180° to the spray position, actuator 27 moves the gun assembly through 90° to the spray position as shown in FIG. 1 and motor 9 turns the rotor about 90° anti clockwise so that the spray gun is in the top position. The nozzle is now aimed downwards towards the top of the pipe. When the rotor reaches this position the top sensor makes contact with the trigger. Actuator 35 operates and the nozzle produces a spray of coating in a fan pattern with the direction of spray radial to the pipe and the long axis of the fan aligned with that of the pipe. The width of the fan is sufficient to coat the weld area and is contained within the cowl. The extraction unit 60 tracks the path of the nozzle and extracts any fumes and/or splashes produced. The rotor continues to rotate for 360° until the top sensor again contacts the trigger at which point actuator 35 momentarily stops the nozzle spraying and the motor is reversed. At this point the pipe has been given a single coat of coating all around its periphery with a small degree of overlap due to the width of the spray and the fact that the rotor tends in practice to slightly overshoot, moving through more than 360°. The amount of overshoot can be varied by adjusting the apparatus and optimised for a particular coating job. Switching off the flow of coating briefly whilst the motor and rotor reverses prevants over coating of the top of the pipe. The flow of coating than restarts and the rotor then rotates through 360° in the opposite direction. The control circuit is arranged so that once the motor has reversed it cannot be reversed again until the home sensor has passed the trigger. This prevents rapid oscillation of the rotor or 'cannoning' due to it slightly overshooting the top sensor which it will then almost immediately encounter n its return journey. When the top sensor again reaches the trigger, signifying that the rotor has moved back through 360°, the rotor either reverses direction as described above and commences another 360° anti clockwise, 360° clockwise coating cycle or valves A and B are operated to divert the flow of coating back to the reservoirs and the rotor returned to the home position. The control unit may be arranged to cause the apparatus to operate for as many cycles as desired. A cycle will typically take 3 to 4 seconds to complete.

Once the last cycle has been completed and the rotor returned to the home position the spray gun is moved to the flush/prime position, the nozzle tip is rotated and valve C opened to flush the nozzle with solvent, the coating purged from the pipeline and solvent is collected in the receptacle.

Once the nozzle has been flushed valve C can be closed, the ring of the rotor unlocked and opened the clamping feet released and the apparatus lifted off the pipe and moved to another coating site.

During coating the nozzle may occasionally block. To deal with this it is possible to momentarily turn around the nozzle tip. This reverses the flow of coating through the tip to unblock it. Reversing can be very quickly effected by actuator 31. Momentarily changing the fan spray to a jet has very little effect on the applied coating, particularly if many cycles are being carried out.

The above described apparatus c nfers numerous advantages over the prior art. By permitting the spray gun to move more than 360° around a pipe only one gun is required. The apparatus is therefore simpler and lighter in weight than conventional apparatus. One spray gun requires only a single pumping system. Solvent and coating losses through flushing the gun are reduced compared with multiple spray gun systems. The ability to turn the nozzle away from the pipe towards a vacuum receptacle significantly reduces the amount of solvent and coating that enters the environment compared to known systems, particularly manual coating. The nozzle of the spray gun is directed substantially radially towards a pipe during coating, this improves the application of coating compared with manual coating as the angle of the nozzle is continually changed by the operator. Provision of an actuator for reversing the nozzle tip enables rapid unblocking of the tip during spraying. Another benefit of using only one nozzle is a reduction in runs or sags in the applied coating because there need be only one point on the periphery of a pipe where the coating overlaps which is the most likely point where running or sagging will occur. With only one overlap point this can be minimised by arranging for the overlap to occur the top of the pipe when it is generally flat. Using the apparatus results in a significant reduction in the amount of coating, material used compared to manual spraying.

The above embodiments is described by way of example only, many variations are possible without departing from the invention.

What is claimed is:

1. Apparatus for spraying a coating onto the outside surface of a pipe comprising:

a body for mounting on a pipe to be coated; and a spray gun mounted on said body wherein the spray gun can move to spray a coating substantially entirely around the periphery of the pipe, wherein the spray gun is pivotally mounted so that the spray gun can pivot and selectively direct said spray away from the surface of the pipe.

2. The apparatus of claim 1 wherein said spray gun is movable through at least a 360 degree range of motion around said pipe.

3. The apparatus of claim 1 wherein said body comprises a ring having a part thereof removed so as to enable said ring to be passed over said pipe.

4. The apparatus of claim 1 wherein said body includes a clamping apparatus configured to selectively clamp said body to said pipe.

5. The apparatus of claim 1 wherein said spray gun is configured to spray said coating in a substantially radial direction towards said pipe.

6. The apparatus of claim 1 wherein said spray gun includes a nozzle with a rotating tip and an actuator for rotating the tip, said tip being rotatable between a first position wherein said tip produces a fan-shaped spray, and a second position wherein said tip produces a jet spray.

7. The apparatus of claim 1 further comprising an extraction unit configured to collect fumes and waster during spraying.

8. The apparatus of claim 7 wherein said extraction unit comprises a hood substantially surrounding said spray gun.

9. The apparatus of claim 7 further comprising a vacuum system connected to said extraction unit, said vacuum system drawing air into said extraction unit.

10. The apparatus of claim 1 further comprising a receptacle into which said spray gun may be pivoted.

11. The apparatus of claim 10 further comprising a vacuum system connected to said receptacle, said vacuum system drawing air into said receptacle.

12. The apparatus of claim 1 adapted for spraying at least a two part coating.

13. The apparatus of claim 1 further comprising a coating supply and a solvent supply, and a valve for selectively admitting either said coating or said solvent to the spray gun.

14. The apparatus of claim 1 further comprising an actuator configured to selectively pivotally operate said spray gun.

15. Apparatus for spraying a coating onto the outside surface of a pipe comprising:

a body for mounting on a pipe to be coated;

a support mounted on the body, wherein the support is movable relative to the body; and a spray gun pivotally mounted to said support, said support being movable relative to said body to enable the spray gun to spray a coating substantially entirely around the periphery of the pipe, said spray gun being pivotally movable relative to said support so as to be able to selectively direct said spray away from the surface of the pipe.

16. The apparatus of claim 15 wherein said spray gun is movable through at least a 360 degree range of motion around said pipe.

17. The apparatus of claim 15 wherein said body comprises a ring having a part thereof removed so as to enable said ring to be passed over said pipe.

18. The apparatus of claim 15 wherein said body includes a clamping apparatus configured to selectively clamp said body to said pipe.

19. The apparatus of claim 15 wherein said support comprises a ring formed from at least two pivotally connected segments, said segments being selectively pivotally movable from a closed position to an open position to mount said support on said pipe.

20. The apparatus of claim 19 further comprising an actuator for selectively opening and closing said segments of said ring.

21. The apparatus of claim 20 further comprising a drive configured to selectively rotate said support relative to said body.

22. The apparatus of claim 15 wherein said spray gun is configured to spray said coating in a substantially radial towards said pipe.

23. The apparatus of claim 15 wherein said spray gun includes a nozzle with a rotating tip and an actuator for rotating the tip, said tip being rotatable between a first position wherein said tip produces a fan-shaped spray, and a second position wherein said tip produces a jet spray.

24. The apparatus of claim 15 further comprising an extraction unit configured to collect fumes and waste during spraying.

25. The apparatus of claim 24 wherein said extraction unit comprises a hood substantially entirely surrounding said spray gun.

26. The apparatus of claim 24 further comprising a vacuum system connected to said extraction unit, said vacuum system drawing air into said extraction unit.

27. The apparatus of claim 15 further comprising a receptacle into which said spray gun may be pivoted.

28. The apparatus of claim 27 further comprising a vacuum system connected to said receptacle, said vacuum system drawing air into said receptacle.

29. The apparatus of claim 15 adapted for spraying at least a two part coating.

30. The apparatus of claim 15 further comprising a coating supply and a solvent supply, and a valve for selectively admitting either said coating or said solvent to the spray gun.

31. The apparatus of claim 15 further comprising an actuator configured to selectively pivotally operate said spray gun.

* * * * *